United States Patent [19]

Bingler

[11] Patent Number: 4,967,936

[45] Date of Patent: Nov. 6, 1990

[54] BEVERAGE DISPENSER

[75] Inventor: Douglas J. Bingler, Furlong, Pa.

[73] Assignee: Milton Roy Co., St. Petersburg, Fla.

[21] Appl. No.: 462,964

[22] Filed: Jan. 4, 1990

Related U.S. Application Data

[63] Continuation of Ser. No. 245,752, Sep. 16, 1988, abandoned.

[51] Int. Cl.[5] ..... B67D 5/56

[52] U.S. Cl. ..... 222/129.2; 222/137; 222/129.4; 99/323.2

[58] Field of Search ..... 222/135, 136, 137, 129.2, 222/129.4, 129.1, 409, 145; 99/323.2, 323.1; 137/99

[56] References Cited

U.S. PATENT DOCUMENTS

| | | | |
|---|---|---|---|
| 2,427,429 | 9/1947 | Waite et al. | 222/129.2 |
| 2,547,423 | 4/1951 | Wegman et al. | 222/129.2 |
| 2,566,436 | 9/1951 | Waite | 222/129.2 |
| 2,675,946 | 4/1952 | Strempel | 222/137 |
| 2,736,466 | 2/1956 | Rodth | 222/136 |
| 2,880,912 | 4/1959 | Fisher | 222/129.4 |
| 3,640,433 | 2/1972 | Rodth | 222/129.4 |
| 3,975,128 | 8/1976 | Schluter | 222/136 |
| 4,136,708 | 1/1979 | Cosentino et al. | 222/137 |

*Primary Examiner*—Michael S. Huppert
*Assistant Examiner*—K. Noland
*Attorney, Agent, or Firm*—Woodcock Washburn Kurtz Mackiewicz & Norris

[57] ABSTRACT

A beverage dispenser includes a cylinder having a pair of chambers, one for dispensing water and the other for dispensing a syrup. A separate piston is in each chamber and the pistons are connected to operate in unison. The water dispensing chamber is connected at one side of its piston to a source of drinking water and to a dispensing nozzle, and is connected at the other side of its piston to an operating medium, such as a liquid or gas under pressure. The syrup dispensing chamber is connected to a source of syrup and to a dispensing nozzle. The operating medium enters the first chamber to move the pistons and force water and syrup from their respective chambers to the dispensing nozzles where they are dispensed into and mixed together in a drinking container. The cylinder includes means for returning the pistons to their initial positions and causing water and syrup to refill the chambers. The dispenser may include a carbonator for mixing the water with carbon dioxide gas, which can also be the operating medium, to form carbonated water.

14 Claims, 5 Drawing Sheets

BEVERAGE DISPENSER

This is a continuation of application Ser. No. 245,752, filed Sept. 16, 1988 now abandoned.

FIELD OF THE INVENTION

The present invention relates to a beverage dispenser, and, more particularly, to a beverage dispenser which can dispense carbonated beverages and/or uncarbonated beverages.

BACKGROUND OF THE INVENTION

Beverage dispensers include a source of water and a source of the syrup for the particular beverage being dispensed. A dispenser of carbonated beverages also includes a source of carbon dioxide and a container in which the carbon dioxide is mixed with water to form carbonated water. Each of the water and syrup sources is provided with a pump which is operated by an electric motor to provide the appropriate amount of water and syrup for each drink dispensed. Thus, the dispenser includes a number of pumps and motors depending on the number of different drinks that can be dispensed by the dispenser. This makes the system relatively large and expensive. In addition, the dispenser can only be used where there is a source of electricity to operate the pump motors.

SUMMARY OF THE INVENTION

A beverage dispenser includes a cylinder having a chamber and a piston in the chamber. The cylinder is connected at one side of the piston to a source of liquid and to an outlet nozzle for dispensing the liquid into a drinking container. Between the source of the liquid and the cylinder is means for allowing the flow of the liquid only from the source of the liquid to the cylinder. The cylinder is connected at the other side of the piston to a source of an operating medium, such as liquid or a gas under pressure, for operating the piston in one direction to force the liquid in the cylinder on the one side of the piston to the dispensing nozzle.

DETAILED DESCRIPTION OF PREFERRED EMBODIMENTS

Figure 1:
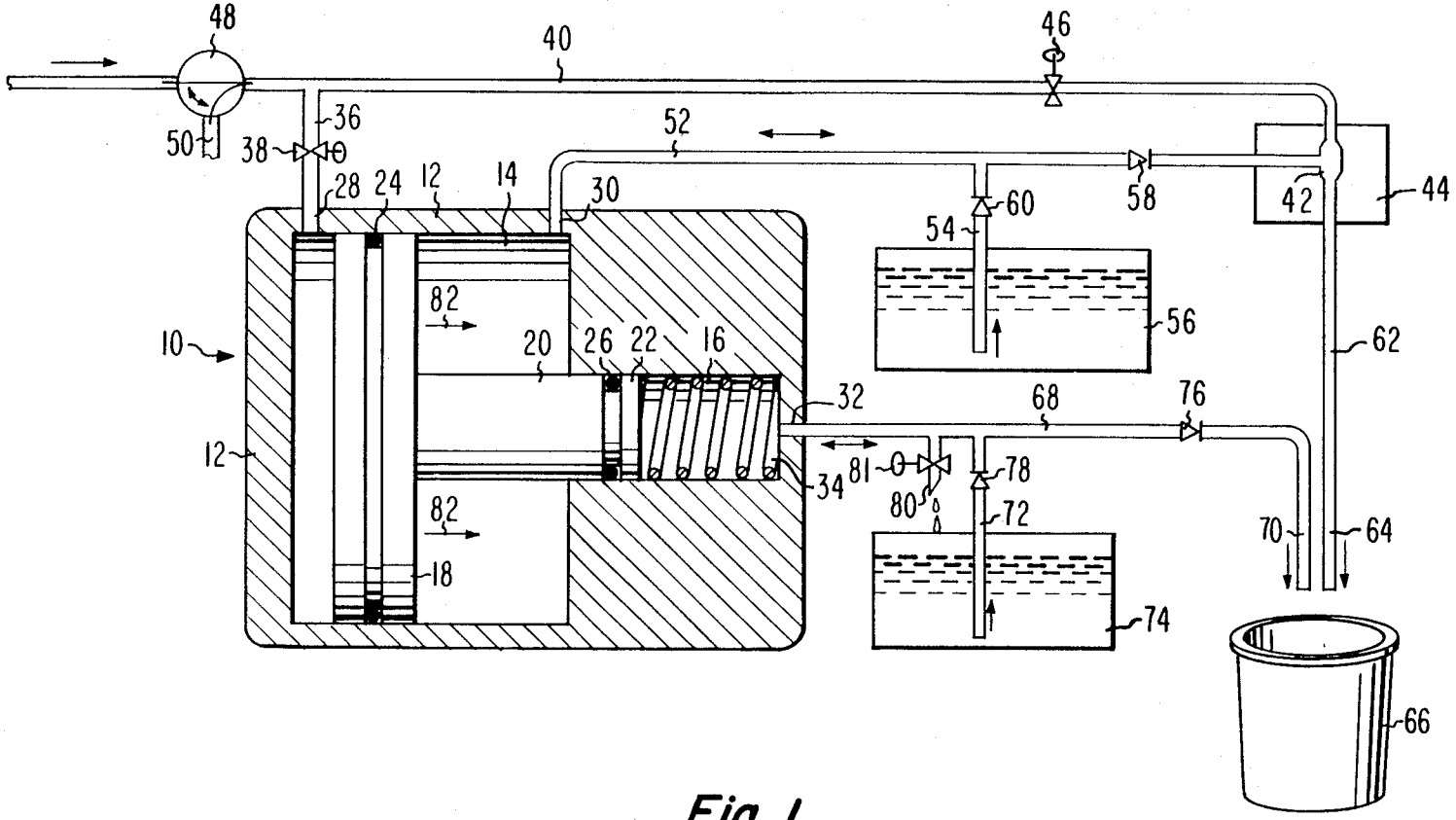
FIG. 1 is a schematic view of a form of the dispenser of the present invention operated by carbon dioxide gas.

Referring initially to FIG. 1, one form of the beverage dispenser of the present invention is generally designated as 10. Beverage dispenser 10 includes a cylinder 12 having a first cylindrical chamber 14 and a second cylindrical chamber 16 extending from and smaller in diameter than the first cylindrical chamber 14. A first piston 18 is in the first chamber 14. A rod 20 extends from the first piston into the second chamber 16 and has a second piston 22 on its end which is in the second chamber 16. Sealing rings 24 and 26 are around the first and second pistons 18 and 22 respectively and seal the space between the peripheries of the pistons 18 and 22 and the outer walls of their respective chambers 14 and 16. A first port 28 extends into one end of the first chamber 14 at one side of the piston 18 and a second port 30 extends into the other end of the first chamber 14 at the other side of the piston 18. A port 32 extends into the second chamber 16 at its end away from the first chamber 14. A helical spring 34 is in the second chamber 16 and is compressed between the second piston 22 and the end of the second chamber 16.

A pipe 36 having a valve 38 therein connects the first port 28 of the first chamber 14 to a piper 40. The pipe 40 is connected at one end to a source of carbon dioxide gas operating medium and at it other end to the mixing chamber 42 of a carbonator 44. A valve 46 is provided in the pipe 40 between the carbonator 44 and the pipe 36. A three way valve 48 is in the pipe 40 between the pipe 36 and the source of carbon dioxide gas. The valve 48 has a third outlet port 50 which is a vent.

A pipe 52 extends from the second port 30 of the first chamber 14 to the mixing chamber 42 of the carbonator 44. A pipe 54 extends between the pipe 52 and a reservoir 56 of water. A one-way check valve 58 is in the pipe 52 between the carbonator 44 and the pipe 54 to allow flow from the first chamber 14 to the carbonator 44 but not in the other direction. A one-way check valve 60 is provided in the pipe 54 to allow flow of water from the reservoir 56 to the first chamber 14 but not in the other direction. A pipe 62 extends from the mixing chamber 42 of the carbonator 44 to a first nozzle 64 which dispenses liquid into a drinking container 66.

A pipe 68 connects the port 32 of the second chamber 16 to a second nozzle 70 which dispenses liquid into the drinking container 66. A pipe 72 is connected between the pipe 68 and a reservoir 74 of a syrup. A one-way check valve 76 is provided in the pipe 68 between the second nozzle 70 and the pipe 72 to allow the flow of liquid from the second chamber 16 to the second nozzle 70 but not in the opposite direction. A one-way check valve 78 is provided in the pipe 72 to allow the flow of liquid from the reservoir 74 to the second chamber 16 but not in the opposite direction. A bleed tube 80 may be provided in the pipe 68 adjacent the pipe 72 and over the reservoir 74. An adjustable one-way valve 81 is in the bleed tube 80.

In the operation of the beverage dispenser 10, the valve 48 is operated to connect the pipe 40 to the source of carbon dioxide gas. Some of the gas will flow through the pipe 36 and first port 28 into the first chamber 14 and press against the first piston 18. This will cause the first piston 18, rod 20 and second piston 22 to move in a direction against the spring 34 as indicated by the arrows 82. This movement of the first piston 18 will force any water in the first chamber 14 ahead of the first piston 18 to flow out of the first chamber 14 through the second port 30 and the pipe 52 and into the mixing chamber 42 of the carbonator 44. The check valve 60 will prevent the water from flowing into the reservoir 56. At the same time some of the carbon dioxide gas flowing through the pipe 40 will also enter the mixing chamber 42 to mix with the water and form carbonated water. The pressure of the first piston 18 on the water will cause the carbonated water in the mixing chamber 42 to flow through the pipe 62 to the nozzle 64 where it is dispensed into the drinking container 66.

The movement of the second piston 22 in the second chamber 16 will cause any syrup in the second chamber 16 to flow through the pipe 68 to the second nozzle 70 where it will also be dispensed into the drinking container 66 simultaneously with the carbonated water. This will form the desired carbonated drink in the container 66. The check valve 78 will prevent the flow of syrup back into the reservoir 74.

When the desired amount of water and syrup have been dispensed, the valve 48 is operated to disconnect the pipe 40 from the carbon dioxide gas source and connect the pipe 36 to the vent pipe 50. This allows the gas in the first chamber 14 to be vented to the atmosphere. As the pressure behind the first piston 18 decreases by the venting of the gas from the first chamber 14, the spring 34 will push the first piston 18, rod 20 and second piston 22 back to their initial positions in their respective chambers 14 and 16. This will create a vacuum in each of the chambers 14 and 16 which will draw water from the reservoir 56 through the pipe 54 and 52 into the first chamber 14 and syrup from the reservoir 74 through the pipes 72 and 68 into the second chamber 16. Thus, the chambers 14 and 16 are refilled with water and syrup respectively so that they are ready to dispense another drink when the valve 48 is operated to admit carbon dioxide gas to the pipe 40.

The diameters of the first and second chambers 14 and 16 and the stroke of the first and second pistons 18 and 22 are designed to provide a ratio of the amount of syrup to the amount of water to achieve a drink having the desired taste. However, the ratio of the amount of syrup to the amount of water can be adjusted slightly by the bleed tube 80. When the syrup is pushed by the second piston 22 to the nozzle 70, some of the syrup will flow through the bleed tube 80 back into the reservoir 74, depending on the size of the opening through the adjustable valve 81, so as to change the amount of the syrup which reaches the nozzle 70. Thus, by adjusting the opening through the adjustable valve 81, a fine adjustment of the ratio of the syrup to water that reaches the drinking container 66 can be made so as to control the taste of the drink. Also, if the dispenser 10 is to dispense a non-carbonated drink, the valve 46 in the pipe 40 is turned off so that no carbon dioxide reaches the carbonator 44, but the carbon dioxide gas is only used to operate the pistons 18 and 22.

Figure 2:
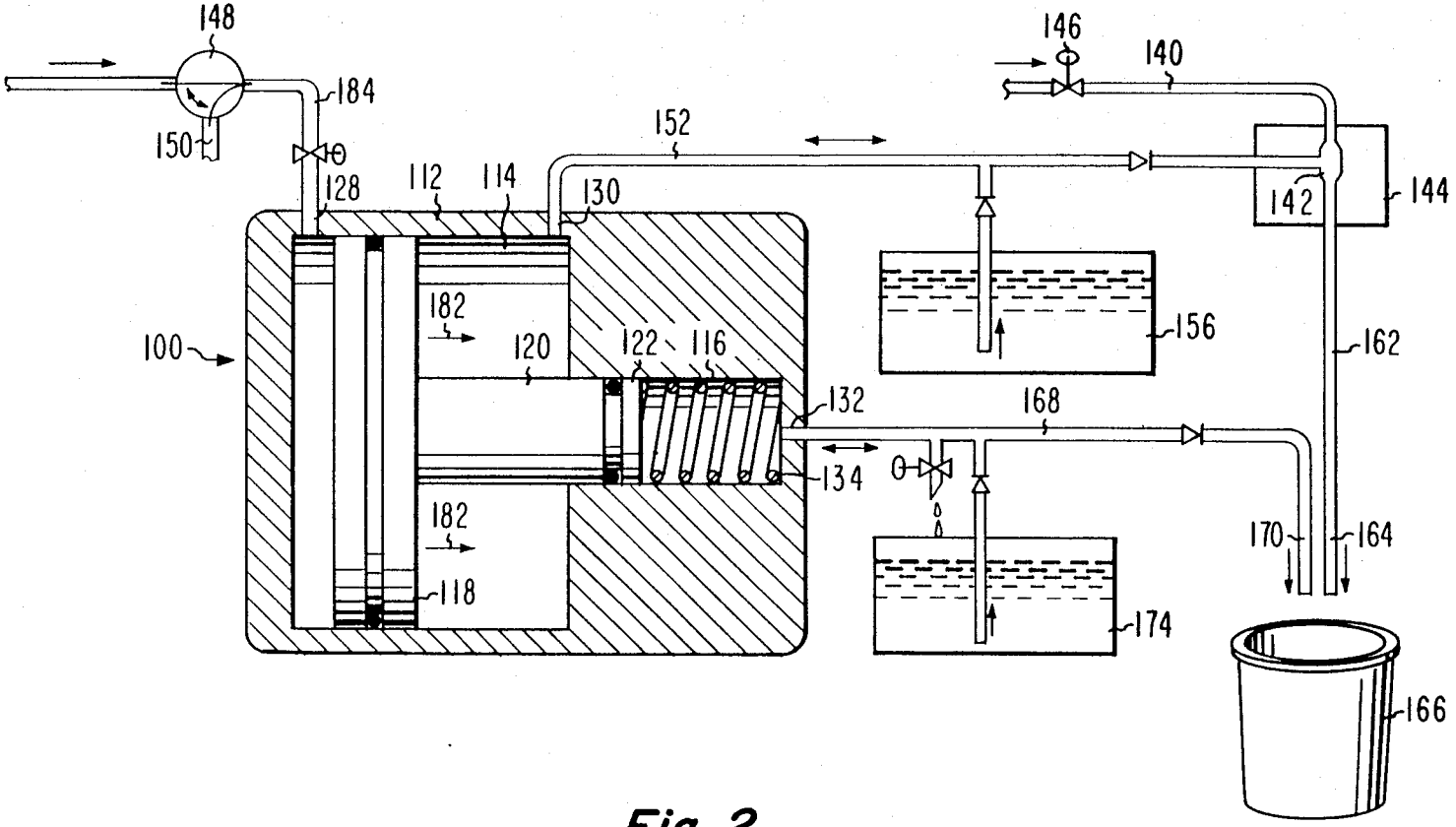
FIG. 2 is a schematic view of a form of the dispenser of the present invention operated by source water.

Referring to FIG. 2, there is shown a beverage dispenser, generally designated as 100, which is similar to the dispenser 10 except that it uses a source of water under high pressure as the operating medium to operate the dispenser. In the dispenser 100, the first port 128 from the first chamber 114 in the cylinder 112 is connected by a pipe 184 through a three-way valve 148 to the source of water under a relatively high pressure. A pipe 140 connects the mixing chamber 142 of the carbonator 144 through a valve 146 to a source of carbon dioxide gas.

In the operation of the dispenser 100, the valve 148 is turned to connect the pipe 184 to the source of water and allow water under pressure to enter the first chamber 114 behind the first piston 118. The pressure of the water pushes the first piston 118, rod 120 and second piston 122 in the direction of the arrows 182. This movement of the first piston 118 forces any water in the first chamber 114 ahead of the first piston 118 out of the first chamber 114 through the second port 130 and pipe 152 to the mixing chamber 142 of the carbonator 144. The water is there mixed with carbon dioxide which is flowing into the mixing chamber 142 through pipe 140 and the carbonated water is forced through pipe 162 to the first nozzle 164 which dispenses the carbonated water into the drinking container 166 At the same time, the second piston 122 pushes any syrup in the second chamber 116 through the port 132 and pipe 168 to the second nozzle 170 which dispenses the syrup into the drinking container 166, thereby forming a drink with the carbonated water.

When the drink has been dispensed, the valve 148 is turned to connect the pipe 184 to the vent pipe 150 . This releases the pressure on the first piston 118 and allows the water in the first chamber 114 behind the first piston 118 to flow to the vent pipe 150. With the pressure on the first piston 118 released, the spring 134 will push the pistons 118 and 122 back to their original positions. This forces the water in the first chamber 114 behind the first piston 118 out of the first chamber 114 and through the vent pipe 150. As the pistons 118 and 122 are moved back, a vacuum is created in the first chamber 114 ahead of the first piston 118 and in the second chamber 116. This draws water from the water reservoir 156 into the first chamber 114 and syrup from the syrup reservoir 174 into the second chamber 116. The dispenser 100 is then ready to dispense another drink. If the source water used to operate the dispenser 100 is of drinking quality, the vent pipe 150 can be connected to the water reservoir 156 so that the water vented from the first chamber 114 will be fed to the water reservoir 156 to maintain the level of water in the water reservoir 156.

Figure 3:
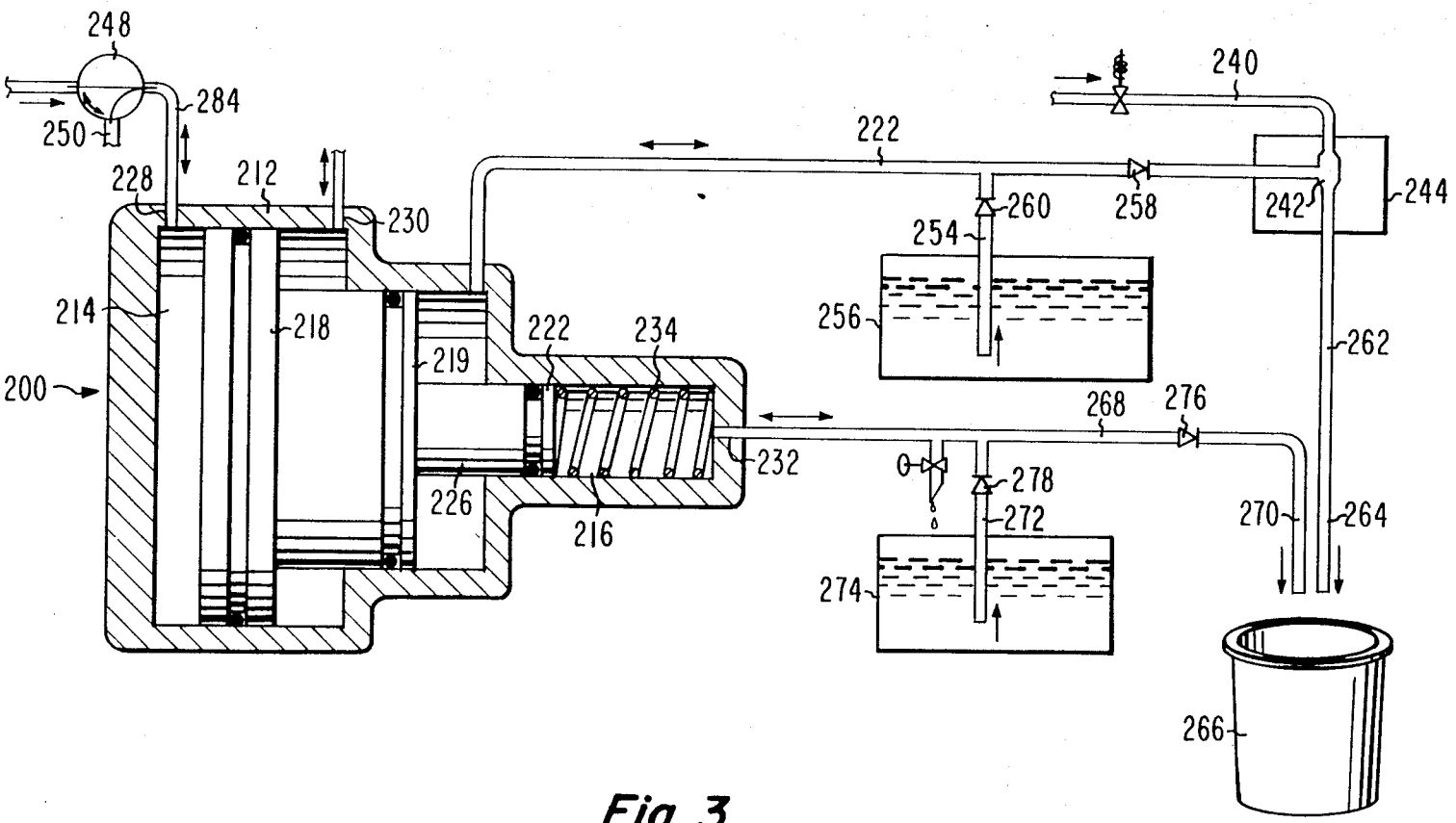
FIG. 3 is a schematic view of another form of the dispenser which is operated by source water.

FIG. 3 shows a water operated dispenser, generally designated as 200, which is similar to the dispenser 100 shown in FIG. 2 except that it capable of being operated with lower pressure water. Dispenser 200 includes a cylinder 212 having a first chamber 214, a second chamber 216 smaller in diameter than the first chamber 212, and a third chamber 217 between the first and second chambers 214 and 216 and of a diameter between that of the first and second chambers 214 and 216. A first piston 218 is in the first chamber 214, a second piston 222 is in the second chamber 216 and a third piston 219 is in the third chamber 217. The second piston 219 is secured to and extends from the first piston 218, and the second piston 222 is on the end of a rod 220 extending from the third piston 219.

A first outlet port 228 is provided for the first chamber 214 behind the first piston 218. The first outlet port 228 is connected by a pipe 284 through a three-way valve 248 to a source of water operating medium at a relatively low pressure, such as the pressure of household water. The third port 250 of the valve 248 is connected to a waste collector or to the water reservoir 256. A second port 230 in the first chamber 214 in front of the first piston 218 is vented. The third chamber 217 has a port 221 which is connected by a pipe 222 and through a one-way check valve 258 to the mixing chamber 242 of the carbonator 244. The pipe 222 is also connected to the water reservoir 256 through a pipe 254 and a one-way check valve 260. The second chamber 216 has a port 232 which is connected by a pipe 268 through a one way check valve 276 to a nozzle 270. The pipe 268 is also connected to a syrup reservoir 274 through a pipe 272 and a one-way check valve 278. A helical spring 234 is in the second chamber 216 between the second piston 222 and the wall of the chamber 216.

A pipe 240 is connected between the mixing chamber 242 of the carbonator 244 and a source of carbon dioxide gas. The mixing chamber 242 is connected by a pipe 262 to a nozzle 264. The nozzles 264 and 276 are positioned over a drinking container 266.

The dispenser 200 operates in the same manner as the dispenser 100 of FIG. 2, described above. However, in the dispenser 200, the drinking water being dispensed is in the third chamber 217 and is forced into the mixing chamber 242 of the carbonator 244 by the third piston 219 when the pistons are moved forward by the pressure of the water under pressure on tee first piston 218. Since the water under pressure in the dispenser 200 is at a lower pressure than the operating water used in the dispenser 100, the third piston 219 is of a diameter smaller than that of the first piston 218 so that a sufficient force will be applied to the drinking water in the third chamber 217 to force the water into the carbonator 244 and then to the nozzle 264. When the spring 234 pushes the pistons back to their initial positions, a vacuum is created in the third chamber 217 and the second chamber 216 to draw water from the reservoir 256 into the third chamber 217 and syrup from the reservoir 274 into the second chamber 216.

Figure 4:
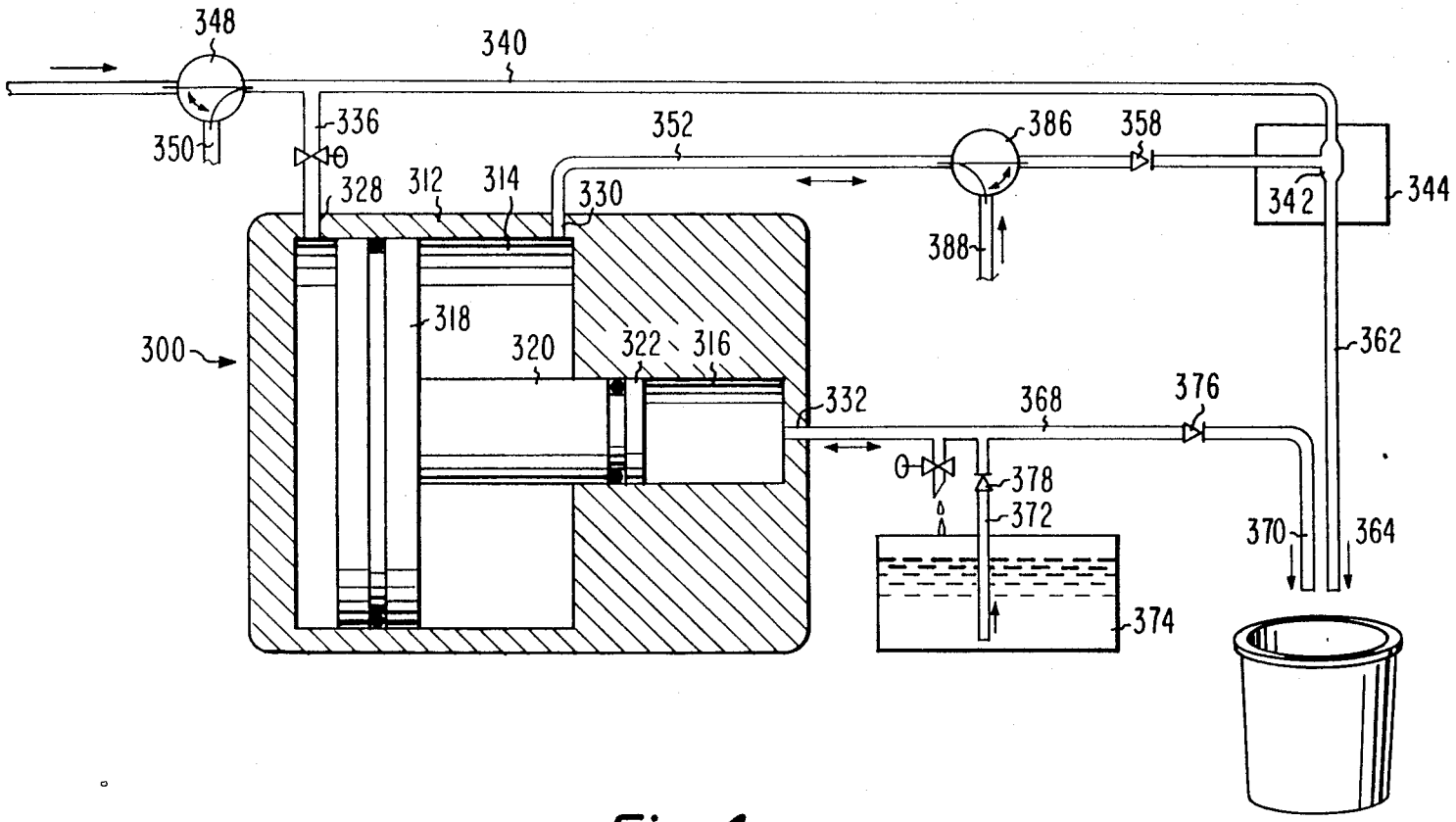
FIG. 4 is a schematic view of a form of the dispenser which is operated by both carbon dioxide gas and source water.

FIG. 4 shows a dispenser, generally designated at 300, which is similar to the dispenser 10 shown in FIG. 1 except that it uses a water return rather than a spring return. The dispenser 300 includes a cylinder 312 having a first chamber 314 and a second chamber 316 smaller in diameter than the first chamber 314 and extending from the first chamber 314. A first piston 318 is in the first chamber 314, a rod 320 extends from the first piston 318 to the second chamber 316 and a second piston 322 is on the rod 320 within the second chamber 316.

The first chamber 314 has a first port 328 behind the first piston 318 which is connected by a pipe 336 to a pipe 340. The pipe 340 is connected at one end to the mixing chamber 342 of the carbonator 344 and at its other end through a three-way valve 348 to a source of carbon dioxide gas. The third port 350 of the valve 348 is vented. The first chamber 314 has a second port 330 which is connected by a pipe 352 through a three-way valve 386 and a one-way check valve 358 to the mixing chamber 342. The third port 388 of the valve 386 is connected to a source of drinking water under pressure. The second chamber 316 has a port 332 which is connected by a pipe 368 through a one-way check valve 376 to a nozzle 370 which is over a drinking container 366. The pipe 368 is also connected by a pipe 372 through a one-way check valve 378 to a syrup reservoir 374. The mixing chamber 342 of the carbonator 344 is connected by a pipe 362 to a nozzle 364 which is over the drinking container 366.

In the operation of the dispenser 300, the valve 348 is turned to connect the pipe 340 to the source of carbon dioxide gas. Some of the gas will enter the first chamber 314 behind the first piston 318 and will apply a force on the first piston 318 moving the piston 318 and 322 forward. The first piston 318 will press on any water in the first chamber 314 in front of the first piston 318 and force the water through the pipe 352 to the mixing chamber 342 where it will mix with carbon dioxide gas admitted into the mixing chamber 342 through the pipe 340. This forms carbonated water which is then forced out of the mixing chamber 342 through the pipe 362 and to the nozzle 364 which dispenses the carbonated water into the drinking container 366. At the same time, the second piston 322 presses on any syrup in the second chamber 316 and forces the syrup through the pipe 368 to the nozzle 370 which dispenses the syrup into the drinking container 366. The syrup mixes with the carbonated water in the drinking container 366 to form the desired carbonated beverage.

After the drink has been dispensed, the valve 348 is turned to connect the first chamber 314 to the third port 350 and thereby vent the portion of the first chamber behind the first piston 318. At the same time the valve 386 is turned to connect the third port 388 to the pipe 352. This allows water under pressure to enter the portion of the first chamber 316 in front of the first piston 318. Since the portion of the first chamber 316 behind the first piston 318 is vented, the pressure of the water entering the first chamber 316 forces the first piston 318 and the second piston 322 back to their initial positions. This also fills the portion of the first chamber 316 in front of the first piston 318 with drinking water. The movement of the second piston 322 back to its initial position creates a vacuum in the second chamber 316 causing syrup to be drawn from the reservoir 374 into the second chamber 316. The valve 386 is then turned to connect the pipe 352 to the carbonator 344 and the dispenser is ready to dispense another drink. Thus, in the dispenser 300, the carbon dioxide is used to operate the cylinder 312 to dispense carbonated water and syrup and form a drink, and the water from the water supply is used to return the pistons to their initial positions and refill the chambers with water and syrup in preparation for dispensing the next drink. In the dispenser 300 instead of having the pipe 336 from the port 328 of the first cylinder 314 connected to a source of carbon dioxide to operate the cylinder 312, the pipe 336 can be connected to a source of water under pressure, such a the dispensers 100 and 200 shown in FIGS. 2 and 3, so as to be water operated.

Figure 5:
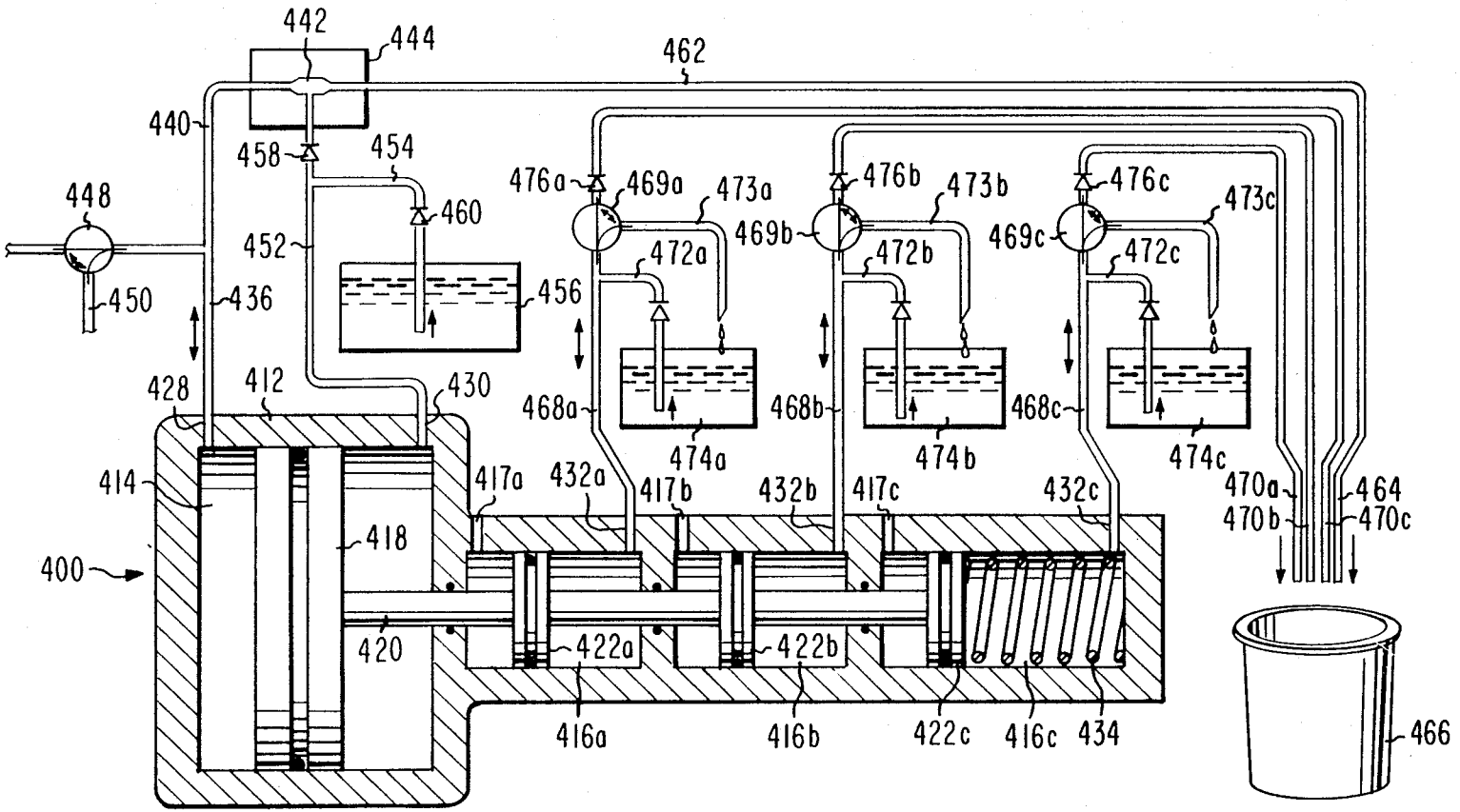
FIG. 5 is a schematic view of a form of the dispenser similar to that of FIG. 1 but which can dispense a plurality of different drinks.

FIG. 5 shows a dispenser, generally designated as 400, which is similar to dispenser 10 shown in FIG. 1 expect that it can selectively dispenses one or more of a number of different syrups. The dispenser 400 includes a cylinder 412 having a first chamber 414 with a first piston 418 therein and first and second ports 428 and 430 at opposite sides of the first piston 418. The cylinder 412 also has three, longitudinally aligned second chambers **416*a*, 416*b* and 416*c* with a separate second piston 422*a*, 422*b* and 422*c* in each of the second chambers respectively. The second pistons 422*a*, 422*b* and 422*c* are all mounted on a rod 420 extending from the first piston 418. Each of the second chambers 416*a*, 416*b* and 416*c* has a port 432*a*, 432*b* and 432*c* therein in front of its respective second piston, and a vent port 417*a*, 417*b* and 417*c*** therein behind its respective second piston.

The first port 428 of the first chamber 414 is connected by a pipe 436 to a pipe 440 which is connected through a three-way valve 448 to a source of carbon dioxide gas under pressure. The third port 450 of the three-way valve 448 is vented. The pipe 440 is also connected to the mixing chamber 442 of a carbonator 444. The second port 430 of the first chamber 414 is connected by a pipe 452 and through a check valve 458 to the mixing chamber 442 of the carbonator 444. The pipe 452 is also connected by a pipe 454 through a check valve 460 to a reservoir 456 of drinking water. The mixing chamber 442 of the carbonator 444 is connected by a pipe 462 to a nozzle 464 which is over a drinking container 466.

The ports **432*a*, 432*b* and 432*c* of the second chambers 416*a*, 416*b* and 416*c* are connected by separate pipes 468*a*, 468*b* and 468*c* through check valves 476*a*** , 476*b* and 476*c* to nozzles 470*a*, 470*b* and 470*c* respectively which are over the drinking container 466. Each of the pipes 468*a*, 468*b* and 468*c* are connected by pipes 472*a*, 472*b* and 472*c* to separate syrup reservoirs 474*a*, 474*b* and 474*c*, each of which contains a different syrup. In each of the pipes 468*a*, 468*b*, and 468*c*, between the check valves 476*a*, 476*b* and 476*c* and the second chambers 416*a*, 416*b* and 416*c* is a three-way valve 469*a*, 469*b* and 469*c* respectively. The third port 471*a*, 471*b* and 471*c* of each of the valves 469*a*, 469*b* and 469*c* is connected to a fluid return pipe 473*a*, 473*b* and 473*c* which extends over its respective syrup reservoir 474*a*, 474*b* and 474*c*. A helical spring 434 is in the end most of the second chambers 416*c* and is compressed between the end most second piston 422*c* and the end of the second chamber 416*c*.

In the operation of the dispenser 400, the valve 448 is turned to allow carbon dioxide gas under pressure to enter the first chamber 414 behind the first piston 418. This forces the first piston 418 and each of the second pistons 422*a*, 422*b* and 422*c* forward. This movement of the first piston 418 forces water in the first chamber 414 ahead of the first piston 418 out of the first chamber 414 through the pipe 452 to the mixing chamber 442 of the carbonator 444 where it mixes with carbon dioxide gas being fed into the mixing chamber 442 by the pipe 440. The so formed carbonated water is then forced through the pipe 462 to the nozzle 464 where it is dispensed into the drinking container 466.

At the same time the second pistons 422*a*, 422*b* and 422*c* are forcing the syrup from the second chamber 416*a*, 416*b* and 416*c* into the pipes 468*a*, 468*b* and 468*c*. One of the three-way valves, such as the valve 469*c*, is turned to connect its respective pipe 468*c* to its respective nozzle 470*c*. This allows the syrup in the pipe 468*c* to flow to the nozzle 470*c* where it is dispensed into the drinking container 466 to mix with the carbonated water and form a drink. However, the other valves 469*a* and 469*b* are turned to connect there respective pipes 468*a* and 468*b* to their respective fluid return pipes 471*a* and 471*b*. Thus, the syrups in the pipes 468*a* and 468*b* are forced through the fluid return pipes 471*a* and 471*b* back into their respective reservoirs 474*a* and 474*b*.

After the drink has been dispensed, the valve 448 is turned to connect the pipe 436 to the vented third port 450 of the valve 448. This vents the gas from the first chamber 414 and lowers the pressure on the first piston 418. The force of the spring 434 then pushes the pistons 418, 422*a*, 422*b* and 422*c* back to their initial positions. As the pistons return to their initial positions, water is drawn from the reservoir 456 into the first chamber 414 and the syrups are drawn from the reservoirs 474*a*, 474*b* and 474*c* into their respective second chambers 416*a*, 416*b* and 416*c*. With the chambers being refilled, the dispenser is ready to dispense another drink.

Thus, the dispenser 400 can selectively dispense a number of different drinks by properly operating the valves 469*a*, 469*b* and 469*c* to allow a single syrup or a combination of the syrups to be dispensed into the drinking container 466. Although the dispenser 400 is shown as being operated by carbon dioxide gas, it can be operated by water under pressure, such as the dispensers 100 and 200 shown in FIGS. 2 and 3. Also, instead of having a spring return, it can have a water pressure return, such as the dispenser 300 shown in FIG. 4. In addition, instead of having a separate nozzle for each syrup, the pipes 468 can all be connected to a single dispensing nozzle.

Thus, there is provided by the present invention a beverage dispenser in which a cylinder having at least two chambers and a piston in each chamber is used to dispense both the water and syrup. The cylinder is operated either by an operating medium, such as carbon dioxide gas under pressure or water under pressure, which is fed against the piston in one of the chambers. The carbon dioxide gas can be from the same source that supplies gas to a carbonator to which the water from the cylinder is fed to form carbonated water. If water is used, it can be from the same source that provides the water for the beverage. The various pipes of the dispensers can be rigid pipes or flexible tubes. Also, the reservoirs do not have to be open containers as shown in the drawings, but can be enclosed containers. The dispenser of the present invention requires no pumps or motors for operating the pumps. Therefore, the dispenser is less complex and therefore less expensive to manufacture. Also, since the dispenser has no motors, it requires no electricity to be operated. Thus, the dispenser of the present invention can be made portable having only a small container of compressed carbon dioxide to operate it and provide the gas for the carbonated water. Alternatively, the dispenser can be connected to a local water supply to operate it. Although, the various three-way valves can be operated manually, if electricity is available, the vales can be electrically operated and connected to a microcomputer for automatic operation.

I claim:

1. A beverage dispenser comprising:

a cylinder having first and second chambers therein;

a separate piston in each of said chambers;

means connecting said pistons so that they can move in unison;

said first chamber having only a pair of ports therein, one on each side of the piston therein;

means connecting the port in the first chamber at the side of its piston away from the second chamber to a source of operating medium which will enter the first chamber and force the pistons in one direction;

means connecting the port in the first chamber at the side of its piston adjacent the second chamber to a carbonator and to a source of plain water;

said second chamber having only a single port therein on the side of its piston away from the first chamber;

means connecting the port in the second chamber to both a dispensing nozzle and to a source of a syrup;

means connecting the carbonator to a source of carbon dioxide gas; and means connecting the carbonator to a dispensing nozzle to dispense carbonated water.

2. A beverage dispenser in accordance with claim 1 in which the diameter of the second chamber is smaller than the diameter of the first chamber.

3. A beverage dispenser in accordance with claim 2 including means for moving the pistons in the opposite direction when the force of the operating medium on the pistons is removed.

4. A beverage dispenser in accordance with claim 3 in which the means for moving the pistons in the opposite direction is a spring compressed between the wall of the second chamber and the piston in the second chamber.

5. A beverage dispenser in accordance with claim 3 including means between the first chamber and the source of operating medium for selectively connecting the first chamber to atmosphere so as to reduce the pressure of the operating medium on the pistons.

6. A beverage dispenser in accordance with claim 5 in which the source of water and syrup are reservoirs containing the water and syrup respectively.

7. A beverage dispenser in accordance with claim 5 in which the source of water is water under pressure and the source of syrup is a reservoir containing the syrup.

8. A beverage dispenser in accordance with claim 7 in which the source of water under pressure is also the means for moving the pistons in the opposite direction.

9. A beverage dispenser in accordance with claim 5 in which a pipe connects one of the ports of the first chamber to the source of operating medium, a pipe connects the other port of the first chamber to the carbonator and the source of water, and a pipe connects the port in the second chamber to the dispenser nozzle and to the source of syrup.

10. A beverage dispenser in accordance with claim 1 in which the cylinder has a plurality of second chambers with a separate piston in each of said second chambers, each of the pistons in the second chambers being connected to the piston in the first chamber to move in unison, each of said second chambers has means connecting the respective second chamber to a dispensing nozzle and to a separate source of a syrup, and means for selectively allowing the syrups from the second chambers to be fed to the dispensing nozzle.

11. A beverage dispenser comprising:

a cylinder having first and second chamber therein with the diameter of the second chamber being smaller than the diameter of the first chamber;

a separate piston in each of said chambers;

means connecting said pistons so that they can move in unison;

said first chamber having only a pair of ports therein, one on each side of the piston therein;

a pipe connecting the port in the first chamber at the side of its piston away from the second chamber to a source of operating medium which will enter the first chamber and force the pistons in one direction;

a pipe connecting the port in the first chamber at the side of its piston adjacent the second chamber to a dispensing nozzle and to a source of water;

said second chamber having only a single port therein on the side of its piston away from the first chamber;

a pipe connecting the port in the second chamber to both a dispensing nozzle and to a source of a syrup;

means for moving the pistons in the opposite direction when the force of the operating medium on the pistons is removed; and a three-way valve connected in the pipe between the source of operating medium and the first chamber to selectively connect the first chamber with the source of operating medium or to the atmosphere to reduce the pressure on the pistons by the operating medium.

12. A beverage dispenser in accordance with claim 11 including a carbonator in the pipe between the first chamber and its dispensing nozzle which receives water from the first chamber and a pipe connecting the carbonator to a source of carbon dioxide gas which will mix with the water in the carbonator to form carbonated water.

13. A beverage dispenser in accordance with claim 12 in which the side of the first chamber which is connected to the operating medium is connected to the source of carbon dioxide which is connected to the carbonator.

14. A beverage dispenser in accordance with claim 12 in which the side of the first chamber which is connected to the operating medium is connected to a source of water under pressure.

* * * * *